US008727847B2

(12) United States Patent
Laude et al.

(10) Patent No.: US 8,727,847 B2
(45) Date of Patent: May 20, 2014

(54) SYSTEM FOR PLAYING GAMES OF MISDIRECTION AND DETECTION

(76) Inventors: Michael Laude, San Diego, CA (US); Kristen Glass, San Diego, CA (US)

( * ) Notice: Subject to any disclaimer, the term of this patent is extended or adjusted under 35 U.S.C. 154(b) by 0 days.

(21) Appl. No.: 13/534,466

(22) Filed: Jun. 27, 2012

(65) Prior Publication Data

US 2012/0289331 A1 Nov. 15, 2012

Related U.S. Application Data

(63) Continuation of application No. 11/864,183, filed on Sep. 28, 2007, now abandoned.

(51) Int. Cl.
*A63F 9/24* (2006.01)
*G07F 17/32* (2006.01)

(52) U.S. Cl.
CPC ..... *G07F 17/326* (2013.01)
USPC ..... 463/9

(58) Field of Classification Search
CPC ..... A63F 2009/18; A63F 2009/183; A63F 2009/186; G07F 17/326; G07F 17/3272; G07F 17/3276
USPC ..... 463/9
See application file for complete search history.

(56) References Cited

U.S. PATENT DOCUMENTS

| | | | | |
|---|---|---|---|---|
| 5,575,474 | A * | 11/1996 | Rossides | 463/26 |
| 5,646,866 | A * | 7/1997 | Coelho et al. | 715/716 |
| 2005/0187001 | A1 * | 8/2005 | Fishel | 463/9 |
| 2013/0005415 | A1 * | 1/2013 | Thomas et al. | 463/4 |

OTHER PUBLICATIONS

Wikipedia Article on the Password Game Show, http://en.wikipedia.org/w/index.php?title=Password_(game_show).*

* cited by examiner

*Primary Examiner* — Corbett B Coburn

(57) ABSTRACT

A system for playing games of deception and detection. The system allows human players to test their skills at discerning the accuracy or inaccuracy of statements made by other players and conversely, to test their skills at misleading other players. The system enables automated play, simulated opponents, multi-player games across wide or local area networks, evaluation of a players' abilities and performance, along with assistance in improving performance, various levels of play, different forms of input and feedback, upload and management of audio and video clips, management of live audio and video feeds to and from players, automatic timers, challenge matches, high score recording, betting, and tournaments.

8 Claims, 7 Drawing Sheets

SYSTEM FOR PLAYING GAMES OF MISDIRECTION AND DETECTION

CROSS-REFERENCE TO RELATED APPLICATIONS

This application is a continuation of prior application Ser. No. 11/864,183 filed Sep. 28, 2007 now abandoned, and entitled "A Game of Misdirection and Detection". The applicants claim the benefit of the above-identified non-provisional patent application under 35 U.S.C. §120. The entire content of this application is incorporated herein by this reference.

DESCRIPTION

1. Field of the Invention

This invention relates to the fields of single and multiple player games, as well as manual and automated gaming platforms.

2. Description of the Related Art

This invention is a game, a competitive activity testing the skill and luck of one or more human or machine players, who play according to a set of rules, for their own amusement and/or for entertainment of spectators. An essential component of many of the most popular games is that each player must discern the intentions or status of the other player or players, while hiding his or her own intentions and status. A few well known examples include poker, bridge, chess, rock-paper-scissors, football, and tennis.

These games may be played by actual human beings in direct physical contact with each other, or the players may be remote from each other. The players may all be human beings or they may be a mix of humans, machines, and computer software. The players may play the game using physical devices such as playing cards or footballs, or they may use automatic computing devices with software that simulates these physical devices. In most of these games, although the detection and misdirection are key elements of the game, other factors and skills play a very large role in determining the outcome of the game.

This invention is a new and unique game that allows players to try both their skill at misdirection and their skill at detecting misdirection against a computer and against other players. Unlike earlier games, the design of this game minimizes the influence of other skills.

SUMMARY OF THE INVENTION

This invention consists of a game, hereafter referred to as the "Game", and a computer-based gaming system, hereafter referred to the "Gaming System". These comprise the method and apparatus of the invention.

The Game may be played by one player against one other player, one player against a simulated opponent, one player against multiple players, or multiple players against multiple players. The basic game play is fairly simple: players win based on how well they misrepresent a situation or on how well they detect whether other player is misrepresenting a situation. Optional features can be added to make the game easier, more challenging, or more stressful.

The Gaming System is a system of computing hardware and software which facilitates the playing of the Game. Although it is not a mandatory component of the invention, the Gaming System greatly enhances the gaming experience and makes possible a number of features, for example, play against a simulated opponent or opponents, evaluation of a player's abilities and performance, along with assistance in improving performance, multi-player games across the internet or other wide or local area network, various levels of play (easy, normal, hard), different forms of input and feedback (text and pointing/selection device only, audio, audio and visual), automatic timers, challenge matches, high score recording, tournaments, and facilities for real and simulated gambling.

BRIEF DESCRIPTION OF THE DRAWINGS

The nature, objects, and advantages of the invention will become more apparent to those skilled in the art after considering the following detailed description in connection with the accompanying drawings, in which like reference numerals designate like parts throughout, and wherein.

DETAILED DESCRIPTION OF SELECTED

Embodiments

This section provides detailed descriptions of four example embodiments. These descriptions of these embodiments are provided as examples of possible embodiments, but are not intended as a complete list of possible embodiments. The following example embodiments will be described in this section:

(1) A basic, two player implementation, without a Gaming System
(2) A two player game using the Gaming System
(3) A multi-player game using the Gaming System
(4) A multi-player game using the Gaming System, including gambling
(5) A televised version of the Game using the Gaming System

Components and Interconnections

Figure 1:
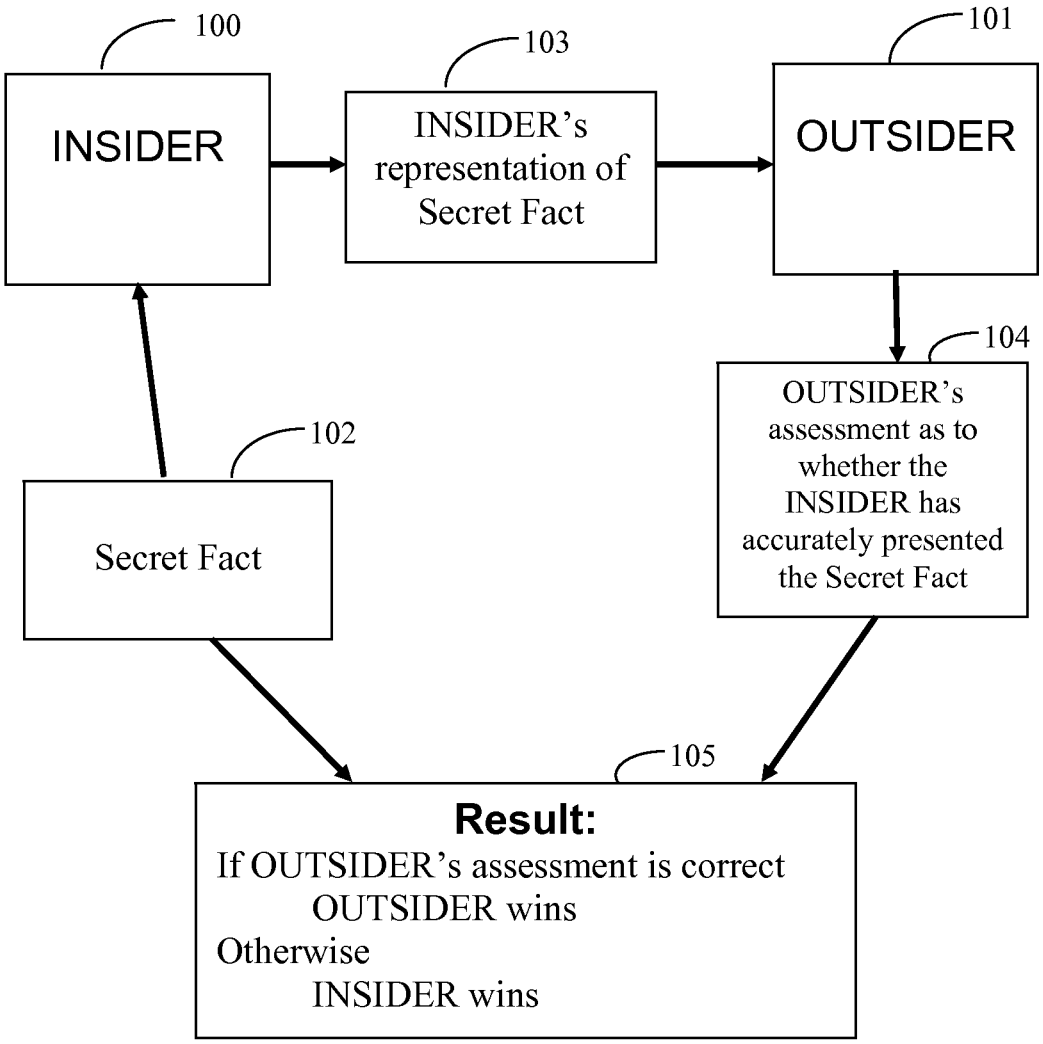
FIG. 1 is an overview of the structure of the Game, showing the major components.

FIG. 1 provides an overview of the basic components of the Game:

(1) An INSIDER (100) is a player to whom a Secret Fact (102) is presented at the beginning of each round of play. The Secret Fact (102) may, for example, be a physical or virtual playing card that none of the other players can see. The INSIDER (100) must provide a representation of the Secret Fact (103) to the OUTSIDER player or players. The Game may accommodate any number of INSIDER players.
(2) An OUTSIDER (101) is a player who must decide whether or not an INSIDER's representation of a Secret Fact is accurate. The OUTSIDER must announce his or her assessment (104). The Game may accommodate any number of OUTSIDER players.

(3) A Secret Fact (102) is something that, at the beginning of each round of play, is known to an INSIDER (100) but not to the OUTSIDER (101) player or players. At the end of each round of play, the Secret Fact is revealed to the OUTSIDER player or players and compared to their assessment (104) of the INSIDER's representation of the Secret Fact (104). If more than one INSIDER is playing the Game, each INSIDER has his or her own Secret Fact.

(4) INSIDER's representation of Secret Fact (103). During each round of play each INSIDER must make a representation of his or her Secret Fact (102). The OUTSIDER players must assess the accuracy of this representation without knowing the Secret Fact.

(5) OUTSIDER's assessment as to whether the INSIDER has accurately presented the Secret Fact (104). Each OUTSIDER must make this assessment of each INSIDER's representation.

(6) The Result (105). At the end of each round, the INSIDER players' representations (103) are compared to the OUTSIDER players' assessments (104) and each INSIDER's Secret Fact (102) is revealed. If the OUTSIDER's assessment is correct, the OUTSIDER wins the round. Otherwise, the INSIDER wins. In a Game with multiple INSIDERS and multiple OUTSIDERS, a result is calculated for each INSIDER-OUTSIDER pairing. The total result for each player after each round may be calculated in a number of different ways; some examples are provided below in the sections labeled "Multi-Player Game, Using Gaming System" and "Betting".

Figure 2:
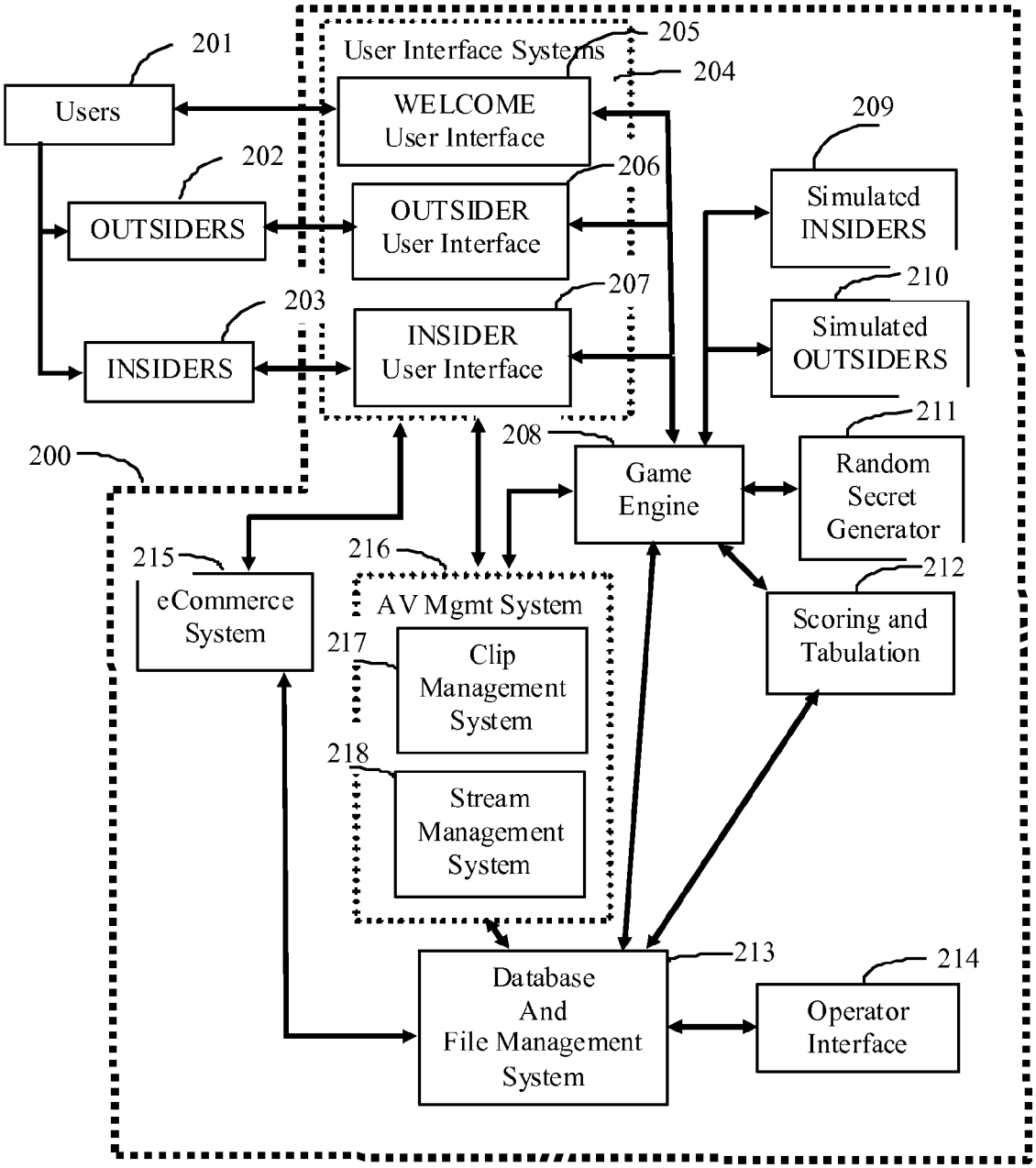
FIG. 2 is an overview of the structure of the Gaming System, showing the major components.

FIG. 2 provides an overview of the basic components of the Gaming System (200). The Users (201) connect to the User Interface System (204). Users who are first time players, potential players, or just curious initially connect to the WELCOME User Interface (205). If a User decides to become a player, he or she must decide whether they want to play as an INSIDER (203) or an OUTSIDER (202). INSIDERS connect to the INSIDER User Interface (207) and OUTSIDERS connect to the OUTSIDER User Interface (206). The User Interface Systems connect to the Game Engine (208), the Audio/Video Management System (216), and the eCommerce Engine (215) to provide Gaming System functions and Game play to players.

The Game Engine (208) is the center of the Gaming System (200). It coordinates and directs requests to and from the User Interface Systems and directs the work of the other systems and engines in providing the gaming experience to the players. Since the Game Engine (208) is responsible for directing the play of the game, it also directs the play of the Simulated INSIDERS (209) and Simulated OUTSIDERS (210). There is no theoretical limit on the number of simultaneous Games and Players that the Game Engine (208) and the other components of the Gaming System (200) can support; available processing power, memory, other storage, and input/output bandwidth determine the actual limits. The Game Engine (208) and the other Gaming System components are designed to scale so that an initial deployment of the Gaming System (200) can run on a minimal set of hardware and specialized software, which can be expanded in modular increments as user demand increases.

The Random Secret Generator (211) is a key component of the Gaming System (200). The Game Engine (208) relies on the Random Secret Generator (211) to produce pseudo-random secrets, for example, simulated playing cards, to each INSIDER at the start of each round of play. Since current computing systems are deterministic devices, it is generally accepted that it is very difficult to produce truly random values using such devices, however, there are numerous existing algorithms and methods that can be used to produce values that are, for all practical purposes, random. The Random Secret Generator may use any of these existing methods and algorithms to produce pseudo-random values.

The Scoring and Tabulation (212) System is relied on by the Game Engine (208) to tabulate the score at the end of each round of play and record the results to the Database and File Management System (213). If betting is enabled for a Game, the Scoring and Tabulation System is also responsible for tracking all of the Player bets, calculating the payouts at the end of each round of play, and recording the results. The Game Engine (208) is responsible for retrieving the results from the Database and File Management System (213) and reporting them to the User Interface Systems (204).

The Audio/Video Management System (216) is responsible for managing and tracking all audio and video content. It relies on the Clip Management System (217) to manage audio and video clips and the Stream Management System (218) to manage live streaming audio and video content. It receives requests to retrieve and store content from the User Interface Systems (204) and the Game Engine (208). It stores clips and stream information in the Database and File Management System (213).

The Stream Management System (218) includes a streaming server to stream audio and video content to users. "Streaming" is an essential feature of any real-time audio/visual system as it allows players to see each frame of audio or video content as soon as it becomes available, rather than waiting for an entire clip to download. The Stream Management System (218) also acts a traffic cop to direct streaming traffic between players and allows players to register information about their streams.

The Clip Management System (217) provides audio and video clips in response to requests from the Game Engine (208) and the User Interface Systems (204). It also allows players to store clips into the Database and File Management System (213) for use by the players, other players, and other Gaming System (200) components.

The eCommerce System (215) is responsible for managing all Gaming System financial transactions. These include, but are not limited to, managing credit card transactions, bank transfers, and tax calculations.

Finally, the Operator Interface (214) is used by the operators of the Gaming System (200) to manage, configure, monitor, and operate the Gaming System.

Operation

This section describes the operation of several selected, example embodiments:

(1) A basic, two player implementation, without a Gaming System (2) A two player game using the Gaming System (3) A multi-player game using the Gaming System (4) A multi-player game using the Gaming System, including gambling (5) A televised version of the Game using the Gaming System

Players

As described earlier, there are two types of players:

(1) An INSIDER knows a particular fact, for example, the identity of a card which has been dealt, either physically or virtually, to him or her. The INSIDER is required to make a statement to the OUTSIDER player(s). The INSIDER decides whether or not to reveal the hidden fact in his or her statement.

(2) An OUTSIDER must decide whether an INSIDER's statement reveals or conceals the hidden fact.

Play

The Game can be played without the assistance of the Gaming System, but the Gaming System adds important capabilities: play across the internet, play against simulated players, automatic time management, help features, high score tracking, optional betting, and levels of difficulty.

Basic Two Player Game, without Gaming System

Figure 3:
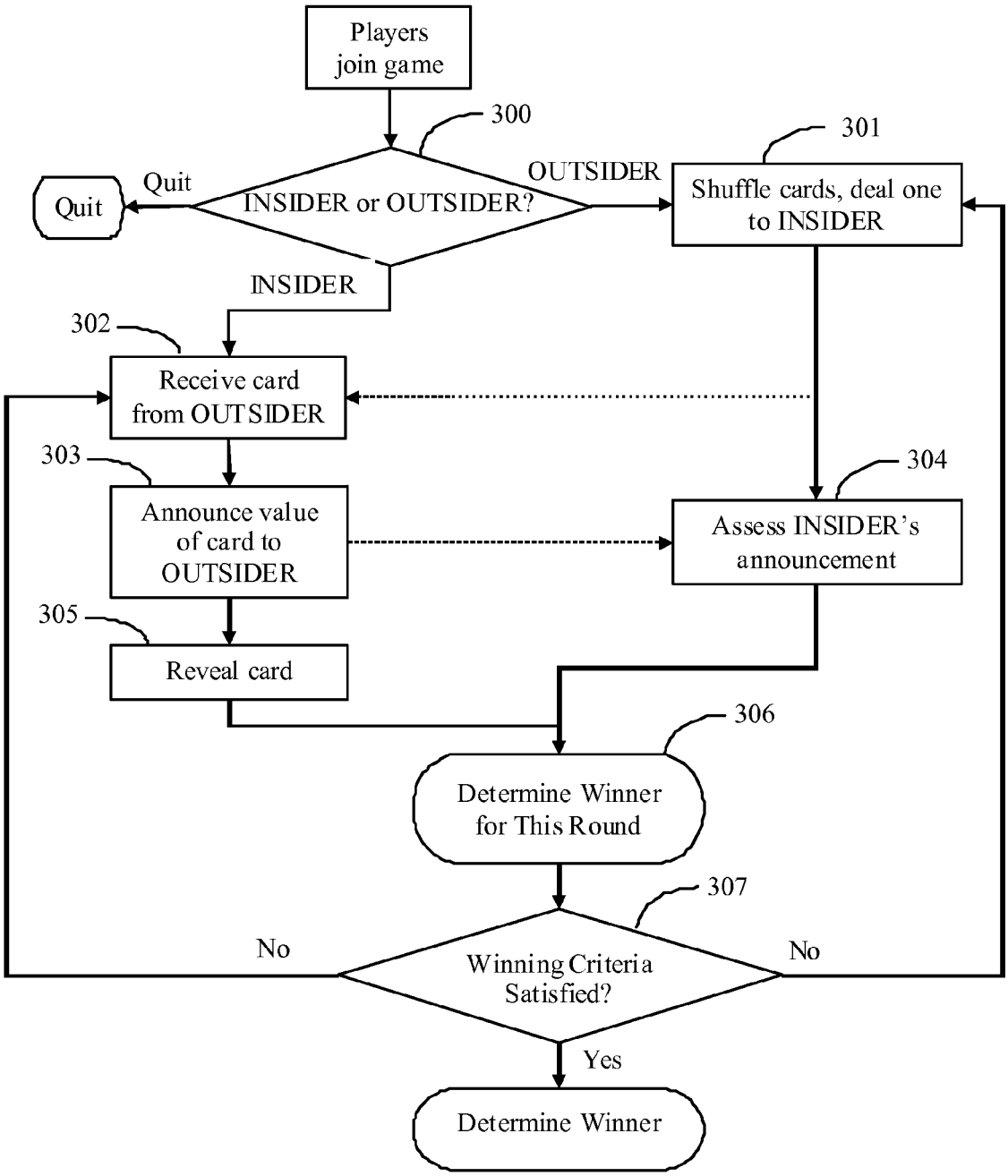
FIG. 3 is a flow diagram of the basic two-player Game, without the use of the Gaming System.

This section provides an example embodiment of basic game play for two players, without a Gaming System and without betting. A flow diagram of this embodiment is shown in FIG. 3.

(1) Each player decides if they want to play as an OUTSIDER or an INSIDER (300). Players agree on the winning margin and/or winning score. Each round of play then proceeds as follows.

(2) The OUTSIDER shuffles the deck. The INSIDER cuts the deck in two at an arbitrary point and places the bottom half of the deck on top of the upper half of the deck. The OUTSIDER then deals one card, face down, to the INSIDER (301).

(3) The INSIDER looks at the card, but does not show it to the OUTSIDER (302).

(4) The INSIDER announces the value of the card. The announced value may or may not be the actual value of the card (303).

(5) The OUTSIDER announces his or her opinion as to whether the INSIDER has correctly represented the value of his or her card (304).

(6) The INSIDER turns over the card (305).

(7) The INSIDER wins the round if 1) the OUTSIDER stated that the INSIDER was misrepresenting the value of his or her card, when in fact the INSIDER was accurately representing the value of the card or 2) the OUTSIDER stated that the INSIDER was accurately reporting the value of the card, when in fact the INSIDER was misrepresenting the value of the card. Otherwise, the OUTSIDER wins. In the basic version of the game, players score one point for each win, and no points for each loss (306).

(8) Play continues until one player achieves the negotiated margin of victory (307).

Two Player Game, Using Gaming System

Figure 4:
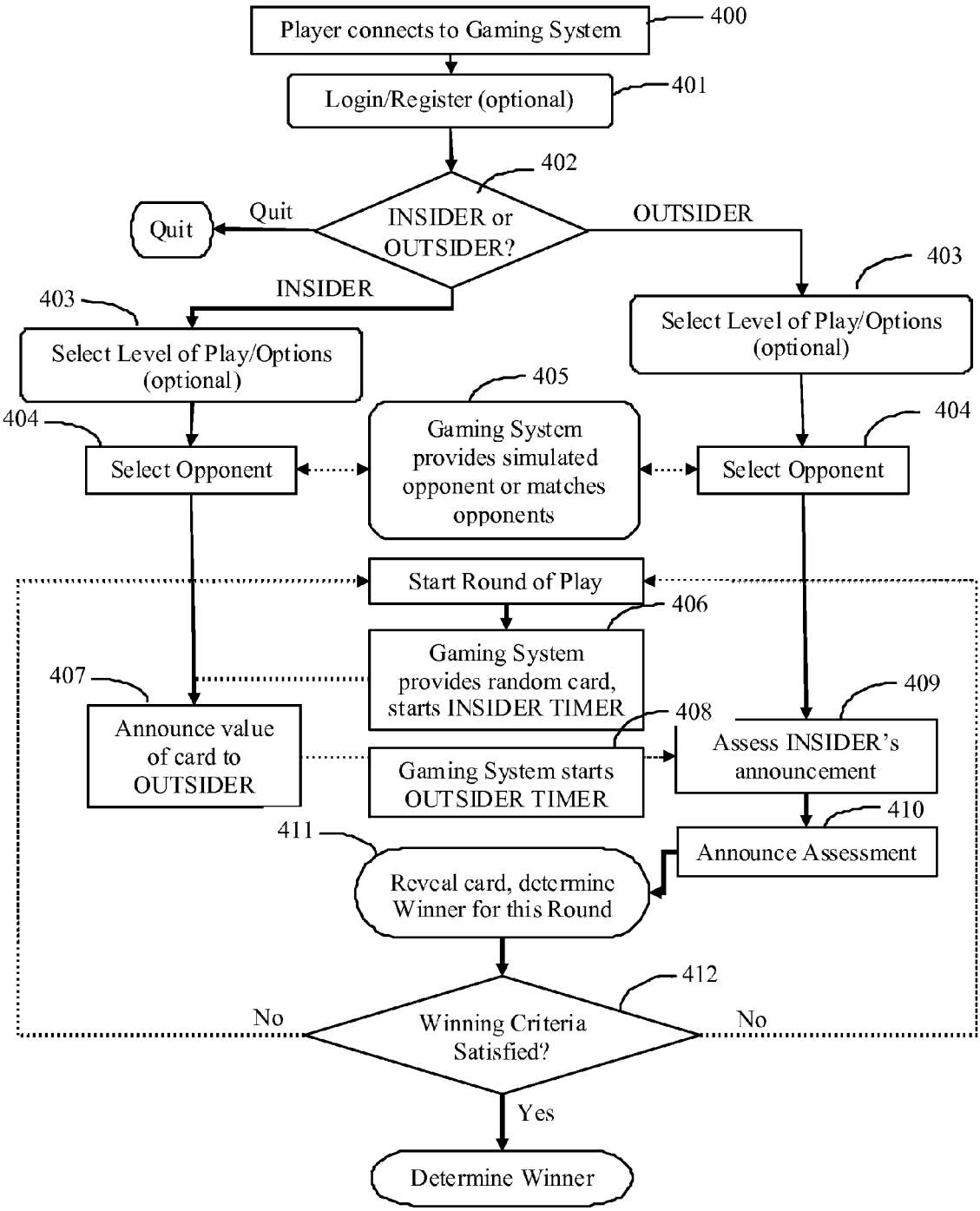
FIG. 4 is a flow diagram of a two-player Game, using the Gaming System.
Figure 5:
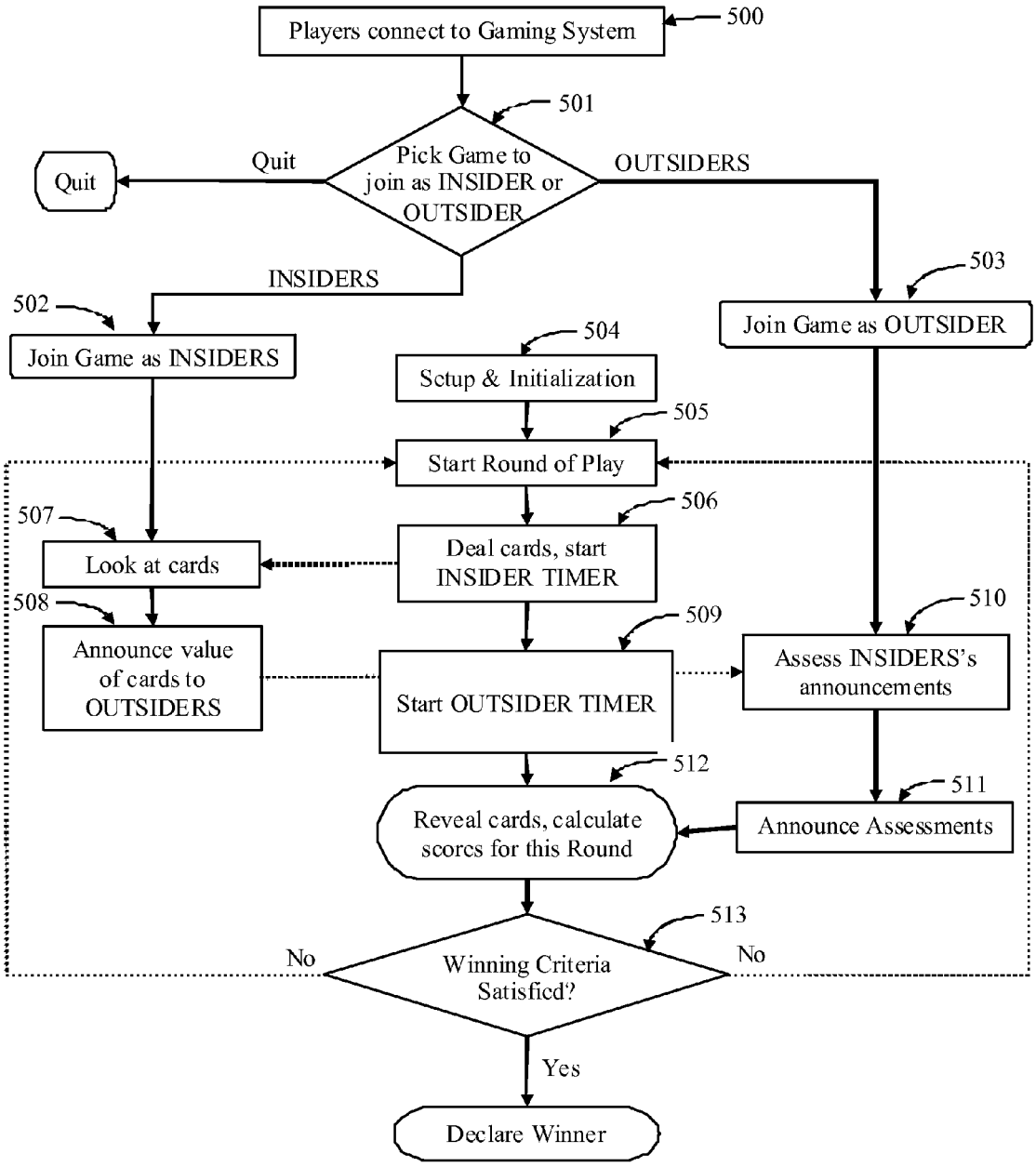
FIG. 5 is a flow diagram of a multi-player Game, using the Gaming System.

A flow diagram for an example of basic game play for two players, using the Gaming System is shown in FIG. 4. This section explains the flow diagram.

(1) A player connects to the Gaming System (400).

(2) Optionally, the player may login or register on the Gaming System's web site (401). The Gaming System maintains information for registered players, for example, high scores, history, default settings, and uploaded audio and video clips.

(3) The player decides to play as either an OUTSIDER or an INSIDER (402). The player may skip the next two steps by choosing the default settings.

(4) The player selects a level of play (403), for example, easy, moderate, or difficult. Different levels have different settings for values such as, for example, time allotted for each player in each round of play, what level of opponents the player will face, and how many times an OUTSIDER can ask an INSIDER to repeat his or her statement.

(5) The player decides what sort of feedback the player will provide to his or her opponent, for example, text and selection only, text, selection, and audio, or text, selection, audio, and video.

(6) The player decides whether to enable the betting feature of the Game. If the player chooses to enable this feature, the player and the Gaming System must make additional decisions, for example, whether to play for actual money, in which case the player must provide some financial information and the Gaming System must decide whether the player may legally bet on the game. If the player chooses to play for virtual money, the player and the Gaming System simply agree on the amount of virtual money the player has, for example, whether the player gets a new pool of virtual money or wishes to carry over money from previous rounds of play.

(7) If the player is an OUTSIDER, he or she selects an INSIDER as an opponent (404). Otherwise, the player selects an OUTSIDER as an opponent (404). Opponents may be either simulated by the Gaming System (405), live humans, or pre-recorded humans. Play is identical in all three cases, except that in the case of a live human opponent, the player must challenge the potential opponent, and the potential opponent must accept the challenge. Play then proceeds for each round of play.

(8) The Gaming System simulates the dealing of a card to the INSIDER (406). The "cards" come from a simulated 52 card deck of standard playing cards. Before each round of play, the Gaming System simulates a shuffle of the deck so that for each round the INSIDER receives a random card. Once the Gaming System verifies that the INSIDER has received his or her "card", the Gaming System starts a timer, hereafter referred to as the INSIDER TIMER. The INSIDER has until the INSIDER TIMER expires to state the identity of his or her card. The value of the INSIDER TIMER depends on the game settings chosen at the beginning of the game. These settings may be modified during the course of the game by mutual consent of the players.

(9) The INSIDER states the value of his or her card (407). Depending on the game settings, this statement may be visual (for example, showing an image of a card and or text describing the card to the OUTSIDER), audio (for example, playing a recorded or live sound clip for the benefit of the OUTSIDER), video (for example, playing a recorded or live video clip for the benefit of the OUTSIDER), or any combination or these or other methods. If the INSIDER TIMER expires before the INSIDER provides his or her statement to the Gaming System, the INSIDER loses the round.

(10) Once the INSIDER provides his or her statement, the Gaming System presents that statement to the OUTSIDER and starts a timer, hereafter referred to as the "OUTSIDER TIMER" (408).

(11) The OUTSIDER has until the OUTSIDER TIMER expires to tell the Gaming System whether the INSIDER has correctly represented the value of the card. Depending on the Game settings, the OUTSIDER may provide this information by selection, text input, audio, video, or any combination of these methods (410). If the OUTSIDER fails to provide this information before the OUTSIDER TIMER expires, the OUTSIDER loses the round.

(12) As soon as the OUTSIDER provides his or her decision, the Gaming System reveals the value of the INSIDER's card and reports the result of the round (411). As in the basic two player game described in the previous section, the INSIDER wins the round if 1) the OUTSIDER stated that the INSIDER was misrepresenting the value of his or her card, when in fact the INSIDER was accurately representing the value of the card or 2) the OUTSIDER stated that the INSIDER was accurately reporting the value of the card, when in fact the INSIDER was misrepresenting the value of the card. Otherwise, the OUTSIDER wins. In the basic version of the game, players score one point for each win, and no points for each loss. If the betting feature of the game is enabled, the winning player collects the moneys that were bet at the beginning of the round.

(13) Play continues until the winning criteria, as described below in the "Winning" section are met (412).

Multi-Player Game, Using Gaming System

An example embodiment of basic game play for multiple players, using the Gaming System:

(1) Players connect to the Gaming System (500) and choose to join a multi-player Game as either OUTSIDERS or INSIDERS (501). The Gaming System schedules multi-player Games and advises players when the Games are starting. Under some circumstances, the Gaming System may allow players to join Games which are already in progress. In the multi-player Game, the players do not get to choose their settings, but they may select different multi-player Games based on the settings of those Games (for example, easy, medium, difficult).

(2) The players join a Game as either OUTSIDERS (503) or INSIDERS (502).

(3) As part of the setup and initialization for a new Game (504), the Gaming System assigns a virtual 52 card deck to each INSIDER.

(4) The Gaming System then starts the first round of play (505) by choosing a card at random from each deck and dealing it to the appropriate INSIDER (506). Before each round of play, the Gaming System simulates a shuffle of the deck so that for each round each INSIDER receives a random card from his or her virtual deck of cards. Once the Gaming System verifies that each INSIDER has received his or her "card", the Gaming System starts a timer, hereafter referred to as the INSIDER TIMER. Each INSIDER has until the INSIDER TIMER expires to state the identity of his or her card. The value of the INSIDER TIMER depends on the game settings chosen at the beginning of the game. The Gaming System may change these settings during the course of the game.

(5) Each INSIDER states the value of his or her card (508). Depending on the game settings, this statement may be visual (for example, showing an image of a card and or text describing the card to the OUTSIDER), audio (for example, playing a recorded or live sound clip for the benefit of the OUTSIDER), video (for example, playing a recorded or live video clip for the benefit of the OUTSIDER), or any combination or these or other methods. If the INSIDER TIMER expires before any INSIDER provides his or her statement to the Gaming System, those INSIDERS lose the round.

(6) Once all the INSIDERS have provided their statements or the INSIDER TIMER has expired, the Gaming System presents those statements to the OUTSIDERS and starts a timer, hereafter referred to as the "OUTSIDER TIMER" (509).

(7) Each OUTSIDER assesses all of the OUTSIDER statements (510) and has until the OUTSIDER TIMER expires to tell the Gaming System whether each INSIDER has correctly represented the value of the card (511). Depending on the Game settings, the OUTSIDER may provide this information by selection, text input, audio, video, or any combination of these methods. If any OUTSIDER fails to provide this information before the OUTSIDER TIMER expires, that OUTSIDER loses the round.

(8) As soon as either every OUTSIDER has provided his or her decision or the OUTSIDER TIMER expires, the Gaming System reveals each INSIDER's card and reports the results of the round (512). In the simplest scenario, each INSIDER gets a point for each OUTSIDER that either 1) stated that this particular INSIDER was misrepresenting the value of his or her card, when in fact the INSIDER was accurately representing the value of the card or 2) the OUTSIDER stated that the INSIDER was accurately reporting the value of the card, when in fact the INSIDER was misrepresenting the value of the card. Each OUTSIDER gets a point for each INSIDER that the OUTSIDER correctly identifies as either accurately or inaccurately reporting the value of his or her card.

(9) If the betting feature of the game is enabled, the Gaming System may pool the bets and, at the end of the round, divide the pool of money proportionally based on the scores tabulated in the previous step. Some sample embodiments of the details of betting and payouts are described below in the "Betting" section.

(10) Play continues until the winning criteria, as described below in the "Winning" section are met (513).

Sample User Interface Examples

Figure 6:
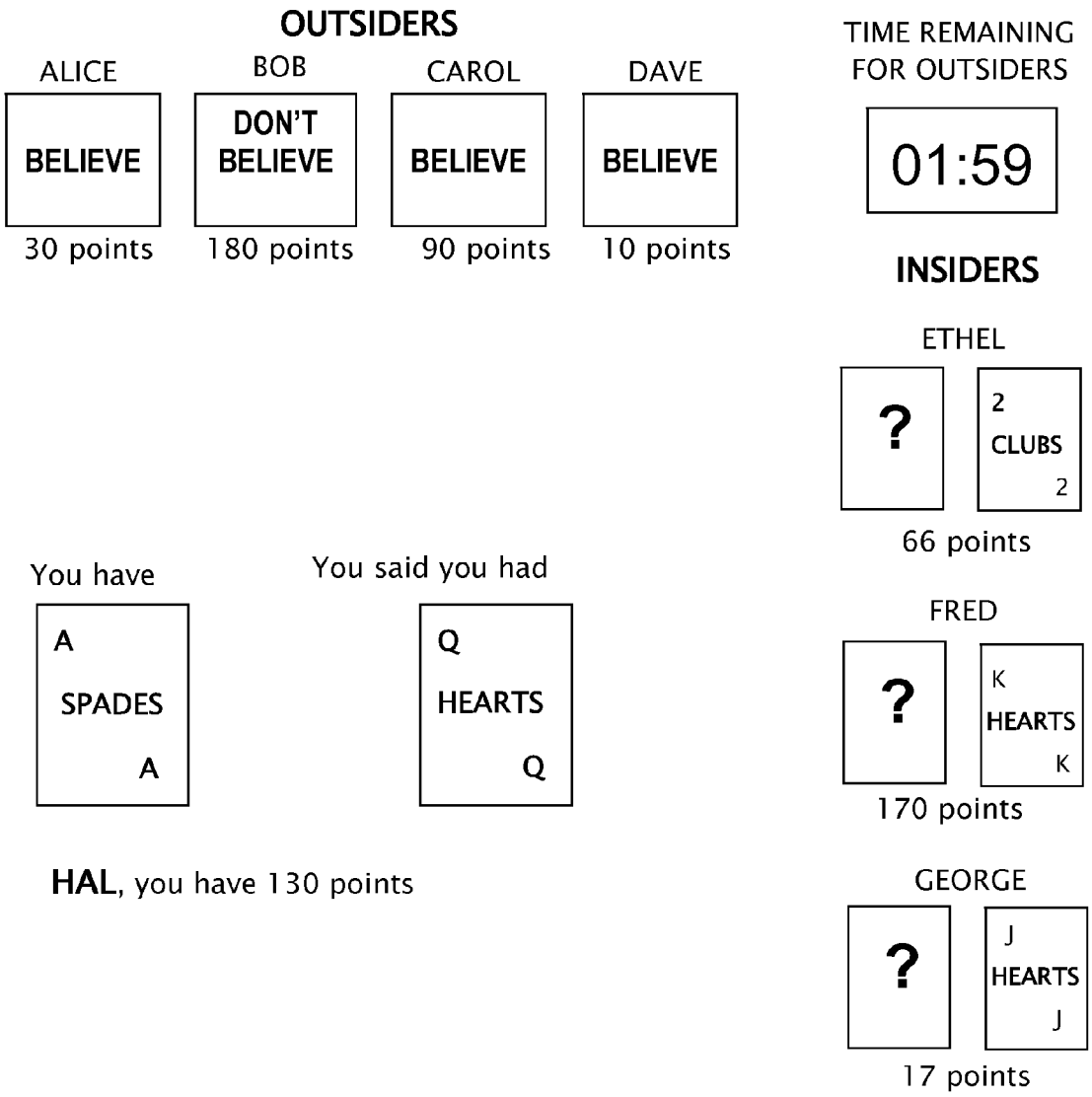
FIG. 6 provides an example of the user interface as seen by the "INSIDER" player in the example embodiment shown in FIG. 2.
Figure 7:
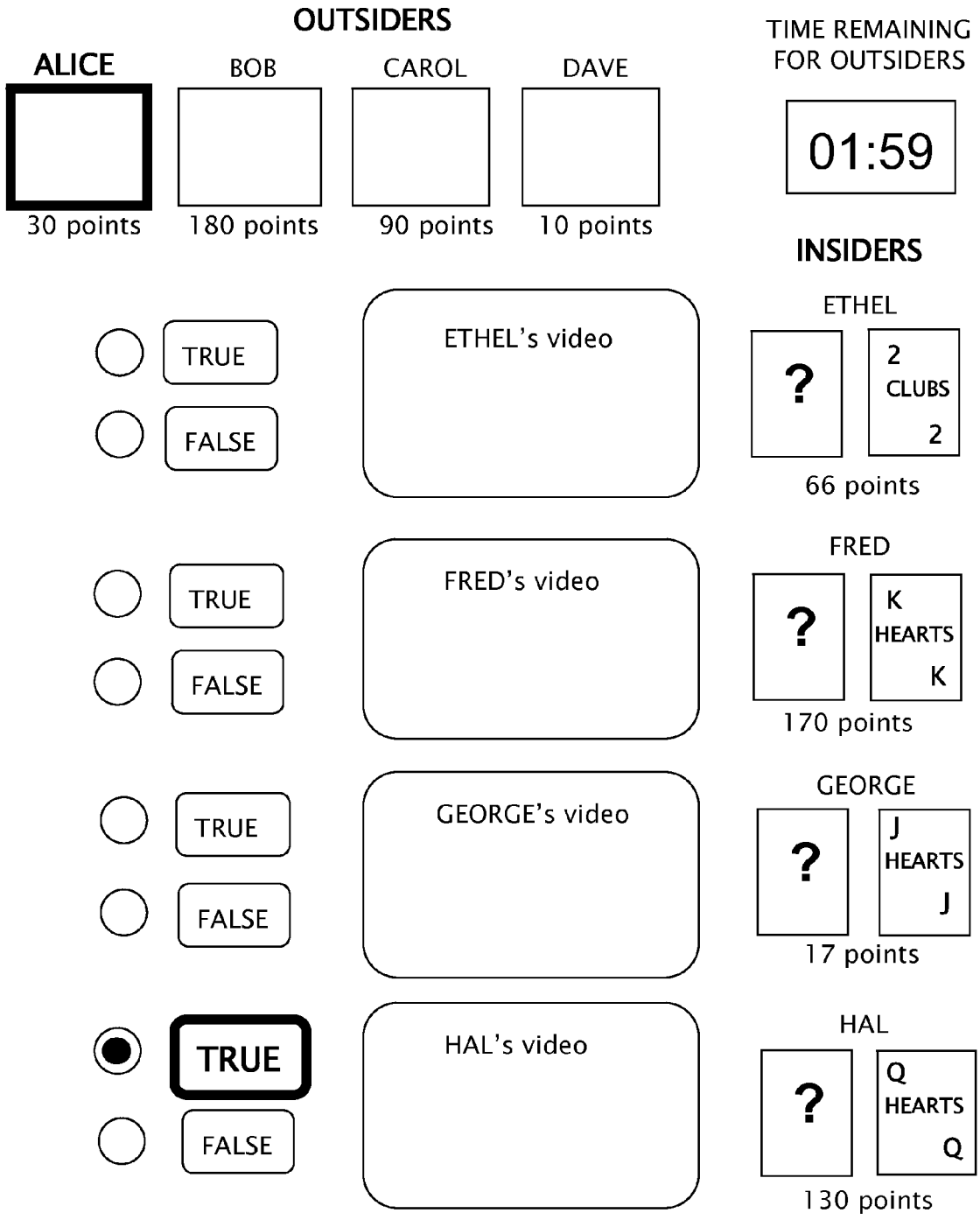
FIG. 7 provides an example of the user interface as seen by the "OUTSIDER" player in the example embodiment shown in FIG. 2

The reader may gain some additional insight into the INSIDER and OUTSIDER user interfaces to the Gaming System by examining FIGS. 6 and 7. These figures show snapshots of a simple example user interface as seen by an example INSIDER, HAL, and an example OUTSIDER, ALICE, at a critical moment in the middle of a round of play. In these two examples, the user interface is greatly simplified in order to make it easier for the reader to discern the key features.

FIG. 6 shows a snapshot of a very simple example embodiment of the INSIDER user interface in a multi-player Game with four INSIDER players and four OUTSIDER players. In this example, the INSIDER player, HAL, has stated that he has the Queen of Hearts, when in fact he actually has the Ace of Spades. The OUTSIDER players have all made their assessments of HAL's statement, the other INSIDERS have all made their statements, and the OUTSIDERS have one minute and 59 seconds to finishing making and announcing their assessments.

FIG. 7 shows a snapshot of the user interface seen by an example OUTSIDER player, ALICE, at the same moment in the game. ALICE has apparently just pushed the "TRUE" button to indicate that she believes HAL's statement. There is a video window for each INSIDER player, where the video appeared of each INSIDER making their statement. In an easier version of the Game, the OUTSIDER might have controls on the video window to allow the OUTSIDER to replay audio/video INSIDER statements. From the digital clock in the upper right hand corner of FIG. 7, Alice knows that she has one minute and 59 seconds to decide whether the statements of the other INSIDERS are true or false.

Simulated Players

As shown in FIG. 2, the Gaming System may create simulated INSIDER (209) and OUTSIDER (210) players. Simulated players provide some advantages over human players. For example, they never tire of the game, can adjust their level of play in response to requests from either the Gaming System or their opponents, and be replaced and upgraded at any time.

In a simple example embodiment, a simulated INSIDER player consists of multiple pre-recorded audio and video clips of a person accurately and inaccurately presenting the value of each possible card. For each round of play, the Gaming System randomly picks an accurate or inaccurate clip to play based on the simulated card it has dealt to the simulated player. Play then proceeds as described above.

An even simpler embodiment of a simulated INSIDER player simply randomly presents either an accurate or inaccurate text and/or graphic representation of the card the simulated player has received.

A simulated INSIDER may also consist of audio and video clips of cartoon characters.

A simple example embodiment of a Simulated OUTSIDER player merely makes a random decision as to whether an INSIDER has accurately represented the value of his or her card. In more sophisticated versions of the Game and the Gaming System, the simulated INSIDER may evaluate the OUTSIDER's statement as well as audio and video, if these are available.

Betting

Numerous forms of betting are possible.

As a very simple example of betting in a two player game, the players bet a fixed amount on each round. The Gaming System or the players, by mutual agreement, may increase the size of the bet after each round or after a certain number of rounds. A player loses or drops out of the game when he or she is unwilling to make the required bet at the beginning of a round.

As a more complicated example, players agree in advance to a set of betting rules, such as those commonly used in poker, for example, the size of each bet, the number of raises, which player bets first, and whether that player must make a minimum bet (often called a "forced" bet) or may decline to bet (often referred to as "checking") and allow the other player to make the first bet. Players must also agree on the number of rounds of betting, for example, one before the card is dealt, one after the card is dealt, and one after the INSIDER declares the value of his or her card.

Both of these examples above can be extended to the multi-player game. In the complete multi-player implementation, each player makes individual bets with every other player. Each INSIDER bets against each individual OUTSIDER and also against each of the other OUTSIDERS. In actual multi-player games with more than four players, this is a large amount of betting and can consume a great deal of time, so the Gaming System introduces some simplifications. A basic example using the Gaming System follows. A group of players may implement these simplifications without the use of the gaming system, but the Gaming System makes the use of these simplifications fast, easy, and eliminates human error. The Gaming System may adjust the process described below for any number of reasons, including, but not limited to, improving game play, and simplifying, streamlining, or complicating the process.

(1) Before joining a Game, the players agree to the Gaming System's rules as to whether a player may take a break from the Game and, if they may, for how long or how many rounds of play. For a televised or tournament version of the Game, the administrator of the Gaming System will usually decide that no breaks are allowed.

(2) At the beginning of each round, the Gaming System determines the initial bet required from each player. In this example embodiment, the Gaming System calculates the bet that it will require each INSIDER to make and the bet that it will require each OUTSIDER to make. The value of these bets need not be the same and the Gaming System may adjust the values in order to eliminate more players or to keep more players in the game. Players are not allowed to participate in the round until they place their bets.

(3) The Gaming System may, but is not required to allow individual players to bet as in the two-player example described above, except that the INSIDER and OUTSIDER bets are pooled separately. The Gaming System may decide randomly, sequentially, or use any other algorithm to decide which player must bet first.

(4) At the end of the round, the money in the Pot is distributed proportionally to the winning players, based on the amount of their bets and the number of individual wins. Calculation of individual wins is as described above in the "Multi-player Game Play". Essentially, the INSIDER players make the same bet with all the OUTSIDER players. More complicated versions of the Game allow each INSIDER to bet against each individual OUTSIDER and also make bets against other INSIDER players. In this more complicated scenario, each OUTSIDER may also bet against each of the other OUTSIDERs.

Winning

Various criteria may be used to determine the winner. Players agree, either explicitly or implicitly, to the winning criteria in advance of play. Some examples of winning criteria for the two player game are, but are not limited to (1) Highest score after a set amount of time (2) First player to achieve an agreed score, optionally by an agreed margin (3) First player to achieve an agreed margin of victory (4) One player concedes victory to the other player by declining to participate in any further rounds of play (5) In versions of the Game that include gambling, a player loses when that player has no more real or virtual money, or declines to place any further bets In a multi-player game, with multiple INSIDERS and OUTSIDERS, winning is a two step process: first, the fields of both INSIDERS and OUTSIDERS are winnowed down to the single best INSIDER and the single best OUTSIDER. The best INSIDER and the best OUTSIDER then play a two person game to decide the ultimate winner. Some example winnowing techniques are described in the previous section.

Article of Manufacture

The simplest embodiment of the invention requires nothing more sophisticated than two players and a deck of playing cards. Any type of cards may be used, as long as they meet three criteria:

(1) The cards must have at least two different values.

(2) For each round of play, there must be some way of delivering a random card to the INSIDER so that both the INSIDER and the OUTSIDER can be assured that the card is indeed random.

(3) The INSIDER must be able to hide the identity of the card until the end of the round.

A more sophisticated embodiment is shown in FIG. 2. In this embodiment, the Gaming System is a sophisticated system of computers, software, and networking equipment that supports features such as, for example, but not limited to, simulated players, play over the internet, live and pre-recorded audio and video, multi-player games, and betting.

Other Embodiments

Despite the specific foregoing descriptions, ordinarily skilled artisans having the benefit of this disclosure will recognize that the apparatus, method, and article of manufacture discussed above may be implemented in an apparatus, system, method, or article of manufacture of different construction without departing from the scope of the invention.

As specific examples of modifications of apparatus and articles of manufacture, the use of specialized playing cards, colors, or symbols rather than standard playing cards does not depart from the scope of this invention.

As a specific example of modification of the method, other artisans may propose new methods of scoring, new criteria for winning, new methods of betting, new rules of play that speed up or slow down the game or make it easier or more difficult or more exciting for players and/or spectators, or changes to the winnowing process in the multi-player game, all without departing from the scope of this invention.

As a specific example of a modification of the apparatus, the internet, the World Wide Web, and local and wide area networks use technologies which are rapidly evolving. Also, the embodiments described in this document envision the players interacting with the Gaming System both through standard web browsers and special, customized clients; it may be desirable to provide the players with either plug-in modifications to their standard browsers or enhancements to custom software clients. Artisans may use new technologies and capabilities to significantly enhance the experience provided by this invention without departing from the scope of this invention.

As a further example of a modification of the apparatus, the Gaming System may require enhancements, upgrades, or modifications in order provide an exciting viewer experience of the televised version of the game. For example, the Gaming System may group players into sections so that only the best INSIDER and the best OUTSIDER in each section move on to the next level, so that by the grand finale of the game, the best OUTSIDERs are arrayed against the best INSIDERS. These changes may be accomplished without departing from the scope of the invention.

What is claimed is:

1. A system for playing a game comprising:
- a user interface system;
- a scoring and tabulation system;
- a random secret generator that generates secrets to be distributed to insider players, said secrets designed such that the system may assess the accuracy of the insider players regarding the secrets;
- an operator interface;
- a game engine that enables game play by
  - managing games so that players may connect to existing games or start new games;
  - for each round of play, generating and distributing secrets to insider players who have elected to receive secrets;
  - prompting the insider players with secrets to present statements to outsider players who have elected to evaluate statements about the secrets;
  - collecting statement evaluations from the outsider players wherein the statement evaluation comprises an evaluation of whether the insider player accurately presented the secret;
  - assessing the statement evaluations to determine winners and losers;
  - tabulating the results;
  - deciding if the game is over and declaring a winner or continuing with the next round of play.

2. The system of claim 1, additionally comprising a system for creating and managing simulated players.

3. The system of claim 1, additionally comprising an audiovisual management system comprising
- a stream management system;
- a clip management system.

4. The system of claim 1, additionally comprising
- a system for creating and managing simulated players; and
- an audiovisual management system comprising
  - a stream management system;
  - a clip management system.

5. The system of claim 1, additionally comprising a betting management system comprising
- an electronic commerce system;
  - a system for presenting the rules to the players;
  - a system for negotiating and managing the betting rules;
  - a system for managing pooled bets;
  - a system for managing individual bets between players;
  - a system for managing multiple betting pools in combination with individual bets so that winnings are distributed proportionately based on the amounts of the individual bets and the individual results against each opponent.

6. The system of claim 5, additionally comprising a system for creating and managing simulated players.

7. The system of claim 5, additionally comprising an audiovisual management system comprising
- a stream management system;
- a clip management system.

8. The system of claim 5, additionally comprising a
- a system for creating and managing simulated players; and
- an audiovisual management system comprising
  - a stream management system;
  - a clip management system.

* * * * *